US009273518B2

(12) United States Patent
Smith et al.

(10) Patent No.: US 9,273,518 B2
(45) Date of Patent: Mar. 1, 2016

(54) METHODS OF COUPLING COMPONENTS OF DOWNHOLE TOOLS, DOWNHOLE TOOLS AND COMPONENTS OF DOWNHOLE TOOLS

(75) Inventors: Redd H. Smith, The Woodlands, TX (US); James Andy Oxford, Magnolia, TX (US); Alan J. Massey, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 589 days.

(21) Appl. No.: 13/283,049

(22) Filed: Oct. 27, 2011

(65) Prior Publication Data

US 2012/0103691 A1 May 3, 2012

Related U.S. Application Data

(60) Provisional application No. 61/408,178, filed on Oct. 29, 2010.

(51) Int. Cl.

| | |
|---|---|
| ***F16C 17/04*** | (2006.01) |
| ***B23K 1/06*** | (2006.01) |
| ***B23K 20/10*** | (2006.01) |
| ***E21B 10/22*** | (2006.01) |
| ***E21B 4/00*** | (2006.01) |
| ***E21B 17/10*** | (2006.01) |

(52) U.S. Cl.

CPC ..... *E21B 10/22* (2013.01); *E21B 4/003* (2013.01); *E21B 17/1085* (2013.01)

(58) Field of Classification Search

CPC ..... F16C 17/04; F16C 33/043; B23K 1/06; B23K 20/10; E21B 10/22; E21B 10/46

USPC ..... 175/371, 425; 228/110.1, 1.1; 384/420, 384/95

See application file for complete search history.

(56) References Cited

U.S. PATENT DOCUMENTS

| | | | | |
|---|---|---|---|---|
| 4,359,112 | A * | 11/1982 | Garner et al. | 175/428 |
| 4,410,054 | A * | 10/1983 | Nagel et al. | 175/107 |
| 4,468,138 | A * | 8/1984 | Nagel | F16C 17/04 228/122.1 |
| 4,738,322 | A | 4/1988 | Hall et al. | |
| 5,092,687 | A * | 3/1992 | Hall | 384/303 |
| 5,147,082 | A * | 9/1992 | Krause et al. | 228/1.1 |
| 5,484,096 | A * | 1/1996 | Tank | 228/121 |
| 6,054,693 | A * | 4/2000 | Barmatz | B23K 1/002 219/678 |
| 6,068,070 | A | 5/2000 | Scott | |
| 6,213,380 | B1 | 4/2001 | Collins et al. | |
| 6,322,902 | B1 * | 11/2001 | Takayama et al. | 428/550 |
| 6,470,558 | B1 * | 10/2002 | Russell et al. | 29/460 |
| 6,659,329 | B1 * | 12/2003 | Hall | 228/111.5 |
| 7,435,377 | B2 * | 10/2008 | Cho et al. | 419/14 |
| 7,487,849 | B2 * | 2/2009 | Radtke | E21B 10/5735 175/420.2 |
| 7,559,695 | B2 * | 7/2009 | Sexton et al. | 384/95 |

(Continued)

*Primary Examiner* — Kenneth L Thompson

(74) *Attorney, Agent, or Firm* — TraskBritt

(57) ABSTRACT

Methods of coupling a bearing assembly to a downhole tool include forming at least a portion of a downhole component from a diamond-enhanced material, applying a metal material to a surface of the downhole component using an ultrasonic molten metal process, and coupling at least a portion of the surface of the downhole component to at least another component of the downhole tool. Downhole tools include at least one component of a bearing assembly that is configured to move relative to a portion of the downhole tool. The at least one bearing component comprises a diamond-enhanced material and is coupled to a portion of the downhole tool by an ultrasonic molten metal process.

19 Claims, 6 Drawing Sheets

(56) References Cited

U.S. PATENT DOCUMENTS

| | | | | |
|---|---|---|---|---|
| 7,901,137 | B1 * | 3/2011 | Peterson | 384/92 |
| 8,034,136 | B2 * | 10/2011 | Sani | 51/293 |
| 2007/0042667 | A1 * | 2/2007 | Sung | 445/51 |
| 2007/0110607 | A1 | 5/2007 | Iwasaki et al. | |
| 2008/0085407 | A1 * | 4/2008 | Cooley et al. | 428/336 |
| 2008/0202814 | A1 | 8/2008 | Lyons et al. | |
| 2009/0152018 | A1 * | 6/2009 | Sani | 175/432 |
| 2009/0205873 | A1 | 8/2009 | Dick et al. | |
| 2010/0038409 | A1 * | 2/2010 | Wilden et al. | 228/121 |
| 2010/0108399 | A1 | 5/2010 | Eason et al. | |
| 2010/0226759 | A1 * | 9/2010 | Cooley et al. | 415/170.1 |
| 2012/0273282 | A1 * | 11/2012 | Lin et al. | 175/434 |
| 2013/0098972 | A1 * | 4/2013 | Trinh et al. | 228/110.1 |
| 2013/0199693 | A1 * | 8/2013 | Tank et al. | 156/60 |

* cited by examiner

METHODS OF COUPLING COMPONENTS OF DOWNHOLE TOOLS, DOWNHOLE TOOLS AND COMPONENTS OF DOWNHOLE TOOLS

CROSS REFERENCE TO RELATED APPLICATION

This application claims the benefit of U.S. Provisional Patent Application Ser. No. 61/408,178, filed Oct. 29, 2010, entitled "Methods of Coupling Components of Downhole Tools, Downhole Tools and Components of Downhole Tools," the disclosure of which is incorporated herein by reference in its entirety.

FIELD

Embodiments of the present disclosure generally relate to coupling components of downhole tools having one or more portions thereof formed from diamond-enhanced materials, and to tools including such materials. More particularly, some embodiments of the present disclosure relate to methods of coupling a bearing assembly for a downhole tool partially comprising a diamond-enhanced material to another component or portion of the downhole tool, and to tools including such bearing assemblies.

BACKGROUND

Downhole tools for earth boring and for other purposes, including rotary drill bits, are commonly used in bore holes or wells in earth formations. One type of rotary drill bit is the roller cone bit (often referred to as a rock bit), which typically includes a plurality of conical cutting structures (often referred to as cones or cutters) secured to legs dependent from the bit body. For example, the bit body of a roller cone bit may have three depending legs each having a bearing pin (otherwise referred to as a journal pin). A rotatable cone may be mounted on each of the bearing pins. The bit body also may include a threaded upper end for connecting the drill bit to a drill string. During drilling, the rotation of the drill string produces rotation of each cone about an associated bearing pin thereby causing the protruding elements on the cone, which may be integrally formed with the cone or comprise inserts secured to the cone, to engage and disintegrate the rock by a crushing and grinding action.

The bearing surfaces employed between the cones and the bearing pin are often the source of significant operational problems during drilling, as these bearings operate in an extremely hostile environment due to high and uneven loads, and elevated temperatures and pressures. Particulate matter present in both the cuttings from a formation being drilled and the solids-laden drilling fluid often enter into the gap between cooperating bearing surfaces, causing accelerated wear. This is particularly true when drilling deep bore holes under high pressures. In addition, rock bits are subject to corrosive chemical environments, again from both the formation environment and chemicals employed in drilling fluids. Another factor that can lead to early bearing failure is the inability of the bearings to withstand changes in the magnitude of forces directed against the roller cone. For example, the side forces (e.g., applied from the side of the bore hole) may tend to deflect the cone off its designed axis of rotation, pinching the bearings and contributing to early bearing failure. In addition, as the bearings wear and gaps between cooperating bearing surfaces increase, more wobble of the cones on the bearing pins may occur. The resulting play in the bearing assembly increases the wear rate on the bearing elements as well as the sealing elements in the cone intended to prevent intrusion of well bore fluids, limiting the usable life of the bit. In addition, the limits of the bearing's capacity may limit both the load that can be applied to the bit as well as the angular velocity at which the bit can be rotated, each of which constrains achievable penetration rates and feasible cutter designs.

In order to withstand the extremely hostile environment, bearings may be formed from a variety of wear-resistant materials. However, further difficulties may arise in coupling or integrating such wear-resistant bearings with the other components of downhole tools in a desirable and reliable manner.

BRIEF SUMMARY

In some embodiments, the present disclosure includes a method of coupling a bearing assembly to a downhole tool. The method includes forming at least a portion of a downhole component from a diamond-enhanced material, applying a metal material to a diamond-enhanced surface of the downhole component using an ultrasonic molten metal process, and coupling at least a portion of the diamond-enhanced surface of the downhole component to at least a portion of another component of the downhole tool.

In additional embodiments, the present disclosure includes a method of coupling a diamond-enhanced material to a downhole tool. The method includes forming a diamond-enhanced material, applying a metal material to a surface of the diamond-enhanced material using an ultrasonic molten metal process; and bonding the diamond-enhanced material to the downhole tool using the metal material in a solid state.

In yet additional embodiments, the present disclosure includes downhole tools formed by the above-listed methods.

In yet additional embodiments, the present disclosure includes a downhole tool comprising a bearing assembly that includes at least one bearing component being movable relative to a portion of the downhole tool. The at least one bearing component comprises a diamond-enhanced material and is coupled to a portion of the downhole tool by a metal material applied to a diamond-enhanced surface of the at least one bearing component with an ultrasonic molten metal process.

BRIEF DESCRIPTION OF THE SEVERAL VIEWS OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure provided with reference to the accompanying drawings, in which:

DETAILED DESCRIPTION

Figure 1:
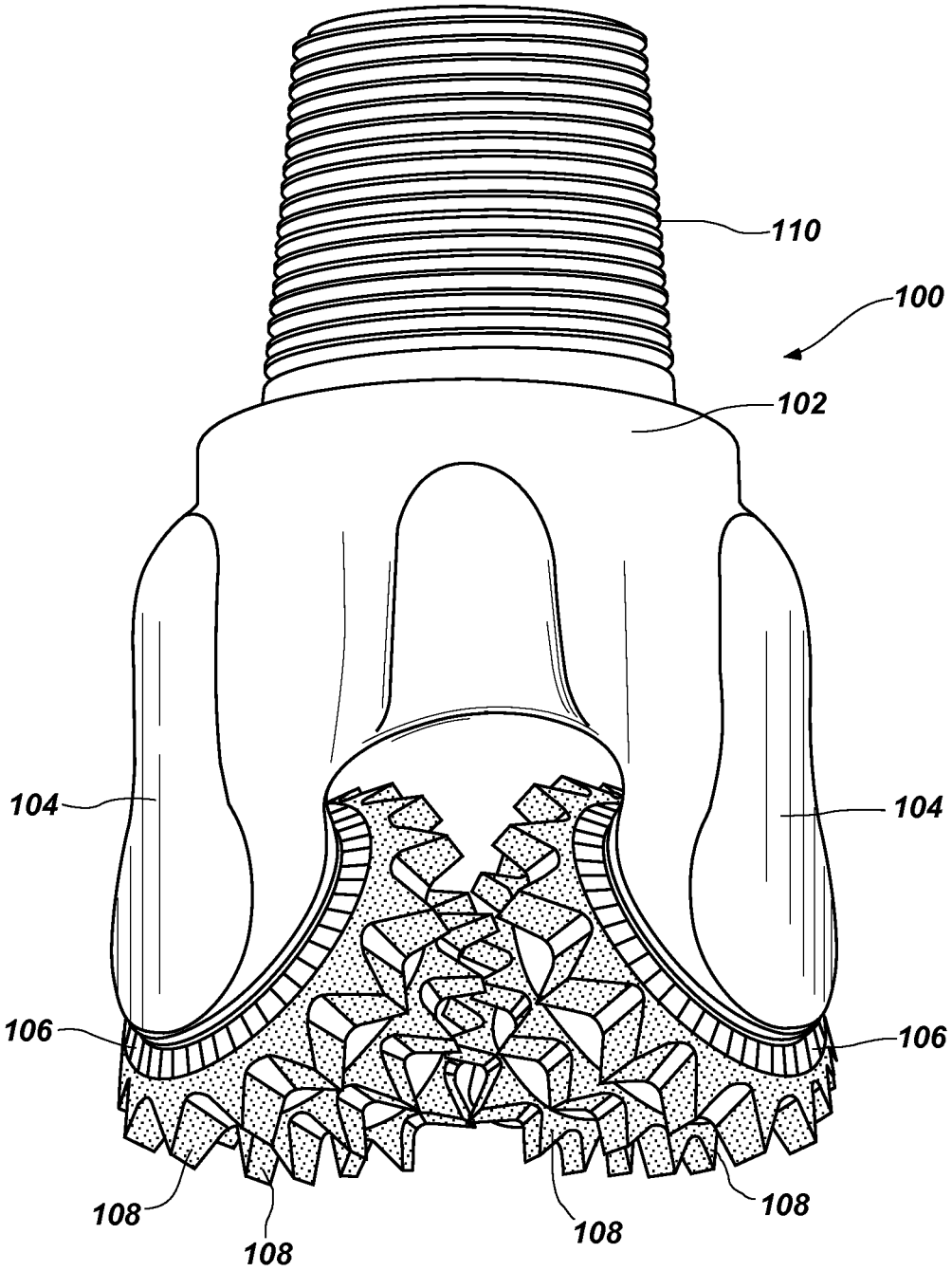
FIG. 1 illustrates a perspective view of a roller cone bit including components coupled thereto in accordance with an embodiment of the present disclosure.

In the following detailed description, reference is made to the accompanying drawings that depict, by way of illustration, specific embodiments in which the disclosure may be practiced. However, other embodiments may be utilized, and structural, logical, and configurational changes may be made without departing from the scope of the disclosure. The illustrations presented herein are not meant to be actual views of any particular material, component, apparatus, assembly, system, or method, but are merely idealized representations that are employed to describe embodiments of the present disclosure. The drawings presented herein are not necessarily drawn to scale. Additionally, elements common between drawings may retain the same numerical designation.

Although some embodiments of the present disclosure are depicted as being used and employed in roller cone bits, persons of ordinary skill in the art will understand that the embodiments of the present disclosure may be employed in any downhole tool where use of a diamond-enhanced material, or a component including a diamond-enhanced material, such as a bearing, is desirable. Accordingly, the term "downhole tool" and as used herein, means and includes any type of tool or drill bit for use in bore holes or wells in earth formations. For example, a downhole tool may employ a component movable (e.g. rotational or translational motion) with respect to another component to which the component is coupled and used for drilling during the formation or enlargement of a wellbore in a subterranean formation and include, for example, earth-boring rotary drill bit, roller cone bits, core bits, eccentric bits, bicenter bits, reamers, mills, hybrid bits employing both fixed and rotatable cutting structures, and other drilling bits and tools employing movable components as known in the art. In some embodiments, a downhole tool may employ a component movable with respect to another component to which the component is positioned adjacent to or mounted, regardless of whether the downhole tool directly engages, shears, cuts, or crushes the underlying earth formation, such as, for example, Moineau-type "mud" motors, turbine motors, roller cone bits, core bits, eccentric bits, bicenter bits, reamers, mills, expandable reamers, expandable bits, hybrid bits employing both fixed and rotatable cutting structures, and other drilling bits and tools employing movable components as known in the art. Further, embodiments of the present disclosure may be employed in components or elements of downhole tools mentioned above that do not exhibit relative motion with respect to another component, but that include a diamond-enhanced material (e.g., a silicon-bonded polycrystalline diamond) that is attached to another component or portion of the downhole tools. For example, a diamond cutting table for a fixed cutter bit or a cutting insert for a roller cone bit coupled to a supporting substrate.

As used herein, the term "diamond-enhanced material" means and includes any material having at least one physical or electrical property that is enhanced by the presence of diamond in the material. Diamond-enhanced materials include materials substantially entirely comprised of diamond, as well as composite materials that include one or more diamond materials therein.

Figure 2:
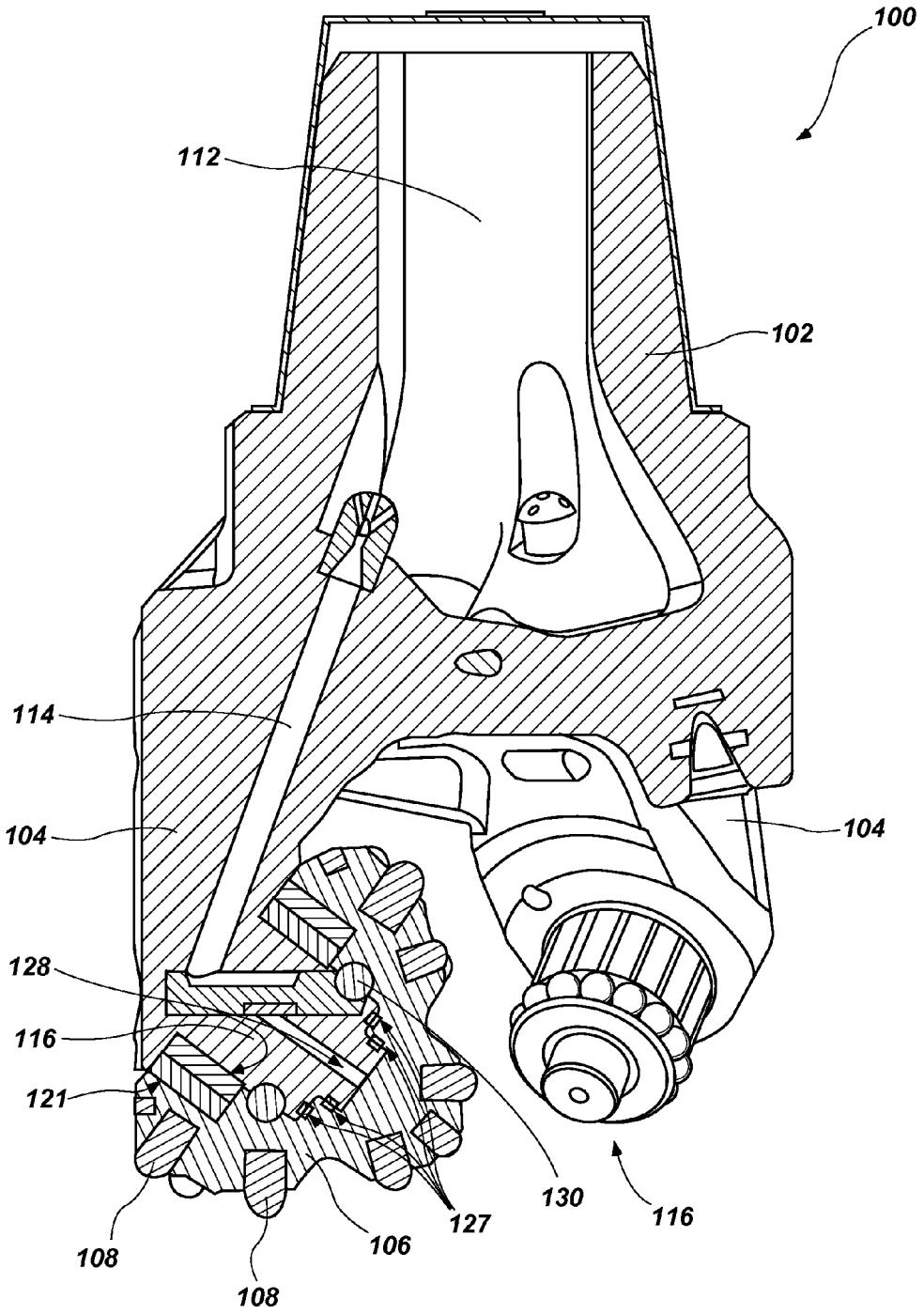
FIG. 2 illustrates a partially cut-away perspective view of a roller cone bit in accordance with another embodiment of the present disclosure.
Figure 3:
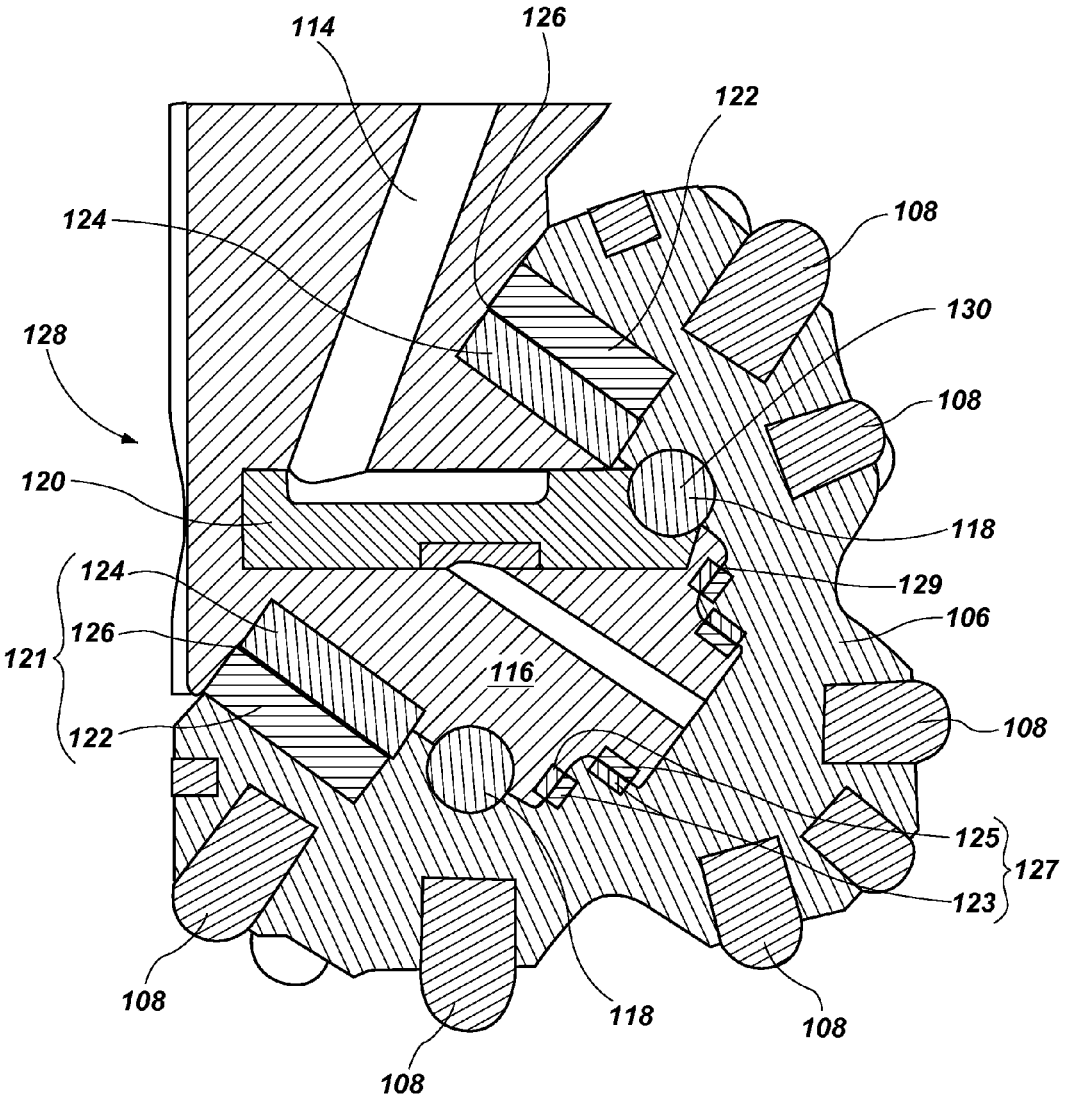
FIG. 3 illustrates an enlarged cross-sectional view of a portion of the roller cone bit shown in FIG. 2.

FIG. 1 is a perspective view of a downhole tool (e.g., an earth-boring rotary drill bit 100). The drill bit 100, depicted as a roller cone bit, includes a bit body 102 having three legs 104 depending from the body 102. A roller cone 106 is rotatably mounted to a bearing pin 116 (FIGS. 2 and 3) on each of the legs 104. Each roller cone 106 may comprise a plurality of cutting elements 108, which as shown may be formed integrally with roller cones 106 during fabrication thereof, and are commonly termed "mill tooth" bits. In some embodiments and as shown in FIGS. 2 and 3, the cutting elements 108 of the roller cone 106 may comprise a plurality of cutting inserts such as the earth-boring drill bits described in, for example, U.S. patent application Ser. No. 11/710,091, filed Feb. 23, 2007, the disclosure of which is hereby incorporated herein in its entirety by this reference. The drill bit 100 includes a threaded section 110 at its upper end for connection to a drill string (not shown). The drill bit 100 may have nozzles (not shown) for discharging drilling fluid into a borehole being drilled by the drill bit 100, which may be returned along with cuttings up to the surface during a drilling operation.

FIG. 2 is a partial cut-away perspective view of an earth-boring rotary drill bit 100 according to another embodiment. The drill bit 100 has an internal plenum 112 that extends through the bit body 102 and fluid passageways 114 that extend from the plenum 112 to a bearing assembly 128. The bearing assembly 128 includes a primary bearing 121 and secondary bearings 127. During drilling, drilling fluid may be pumped down the center of the drill string, through the plenum 112 and fluid passageways 114, and to the bearing assembly 128. The drill bit 100 also includes legs 104 depending from the body 102. Roller cones 106 are rotatably mounted to a bearing pin 116, although one bearing pin 116 is depicted without the roller cone 106 for the sake of clarity. The bearing pin 116 includes the bearing assembly 128, which is more fully described hereinafter. As shown in FIG. 2, the cutting elements 108 may be formed of cemented tungsten carbide and which may have a polycrystalline diamond coating on the distal ends thereof.

FIG. 3 is an enlarged cross-sectional view of the bearing assembly 128 of FIG. 2. The bearing assembly 128 includes generally spherical balls 118 for retaining the cone on the pin, a ball plug or retainer 120, a primary bearing 121 comprising a primary cone bearing member 122 and a primary journal bearing member 124, and secondary bearings 127 comprising secondary cone bearing members 123 and secondary journal bearing members 125. The primary bearing 121 is configured and positioned to primarily bear radial loads and the secondary bearings 127 are configured and positioned to bear radial loads and axial loads, respectively.

During assembly of the bearing components, a roller cone 106 including a primary cone bearing member 122 and secondary cone bearing members 123 is brought into proximity with and placed over a bearing pin 116 including a primary journal bearing member 124 and secondary journal bearing members 125 such that the bearing pin 116 is inserted into the roller cone 106. The primary cone bearing member 122 is placed over and at least substantially surrounds the primary journal bearing member 124 such that an inner contact surface of the primary cone bearing 122 abuts an outer contact surface of the primary journal bearing member 124 at a first interface 126. In other words, the primary journal bearing member 124 is concentrically nested within the primary cone bearing member 122 such that the outer contact surface of the primary journal bearing member 124 is proximate the inner contact surface of the primary cone bearing member 122. The primary cone bearing member 122 and the primary journal bearing member 124 are configured to rotate slidably relative to one another as the roller cone 106 rotates about the bearing pin 116.

The secondary cone bearing members 123 abut the secondary journal bearing members 125 at second interfaces 129. In some embodiments, one or more of the secondary bearings 127 may be configured to bear radial loads in a similar manner to the primary bearing 121. For example, the secondary cone bearing members 123 may be received over one of the secondary journal bearing members 125 such that an outer contact surface of the secondary journal bearing member 125 abuts with an inner contact surface of the secondary cone bearing member 123. In some embodiments, one or more of the secondary bearings 127 may be configured to bear axial loads. For example, the secondary bearings 127 may include another secondary cone bearing member 123 having an upper contact surface abutting a lower contact surface of another secondary journal bearing member 125. The secondary cone bearing members 123 are configured to rotate slidably against the secondary journal bearing members 125 as the roller cone 106 rotates about the bearing pin 116.

The generally spherical balls 118 are inserted into a receiving ball race 130 and the ball plug 120 inserted to retain the generally spherical balls 118 in the ball race. The ball plug 120 may be secured in place using, for example, a weld. As the drill bit 100 (FIG. 2) rotates, the roller cone 106 rotates around the bearing pin 116, and cutting elements 108, depicted in FIG. 3 as discrete cutting elements received in recesses in the surface of roller cone 106, impact and crush the underlying earth formation.

One or more of the components of the bearing assembly 128 of the drill bit 100 (e.g., cone bearing members 122, 123, journal bearing members 124, 125) may be formed from a wear-resistant material such as, for example, a diamond-enhanced material. For example, the diamond-enhanced material may include particles of diamond material embedded in, and mutually bonded by, a continuous phase matrix material (which may be referred to herein as a "matrix"). In some embodiments, the matrix may comprise silicon or a silicon-based material. In some embodiments, the matrix may comprise a carbide material (e.g., silicon carbide, tungsten carbide, etc.). For example, the components of the bearing assembly 128 may be formed from a silicon-bonded polycrystalline diamond. In such materials, the matrix may comprise silicon as a continuous phase in a particle matrix composite structure. The silicon may be reacted with the diamond to form an intermediate silicon carbide (SiC) layer around each diamond particle. Such materials may be provided by the company Element Six (E6) under such commercially available product names as SYNDAX® (i.e., a high temperature, high pressure sintered silicon-bonded polycrystalline diamond), or silicon-bonded diamond also referred to as ScD (i.e., a low pressure, low concentration diamond-enhanced polycrystalline material). The ScD material is produced by a reaction bonding process in which a green body of diamond particles, silicon grit, and carbon (produced by the in-situ surface graphitization of the diamond) is infiltrated with silicon at sub-atmospheric pressure. The silicon reacts with the carbon to form new silicon carbide that grows epitaxially on the existing silicon carbide grains and diamond particles. Once all the available carbon has reacted, any remaining space is filled by the silicon. Another such material may be aluminum nitride intermetallic-bonded diamond and carbide composite.

In some embodiments, the materials discussed above may be used for a variety of bearing assemblies in downhole tools such as roller cone drill bits, mud and turbine motors, and other downhole tools used in mineral exploration. In addition, these materials may be used in a bearing assembly in configurations where one or more components of the bearing assembly formed from the diamond-enhanced materials rub against one another or against another type of wear surface.

One embodiment of a material for these applications may be a diamond-enhanced silicon carbide (SiC) material. For example, the diamond may comprise 30% to 70% (by volume), with a grain size of 5 to 250 microns. Finer materials may have lower diamond content. For example, diamond-enhanced silicon carbide may comprise about 5% to 25% diamond by volume. The diamond may be unsintered, with an open porosity of about 9% in one embodiment. The principle binder phase may comprise βSiC and free Si may be present having 30% to 70% diamond by volume, with a grain size of 5 to 250 microns. In other examples, the material may comprise diamond-enhanced cemented tungsten carbide, in which particles of diamond may be embedded within cemented tungsten carbide material.

In some embodiments of a downhole tool constructed in accordance with the disclosure, the tool has a body having a bearing element (e.g., surface, pin, etc.) extending along an axis. The bearing pin has a journal surface and a nose surface with a smaller diameter than that of the journal surface. A rotatable element (e.g., cone) is rotatably mounted to the bearing pin and has a cavity slidingly engaging the journal and nose surfaces. A diamond-enhanced bearing assembly is between the bearing pin and the rotatable element comprising at least one load carrying bearing surface formed at least in part with diamond-enhanced material.

In some embodiments, the bearing assembly may be installed on at least one of the journal and nose surface of the bearing pin. In some embodiments, the bearing assembly may comprise a plurality of bearing components or members that are formed at least in part with diamond-enhanced material. The bearing components may be installed on both the journal and nose surfaces and on the cavity. In some embodiments, the bearing components may be formed as a partial ring and discontinuous, or may be formed in ring sections. In some embodiments, the bearing components may comprise a thrust bearing made of diamond-enhanced material, a roller, a roller race surface, or a ball and a ball race surface made of diamond-enhanced material. Moreover, these various embodiments may be used in many different combinations as well.

Figure 4:
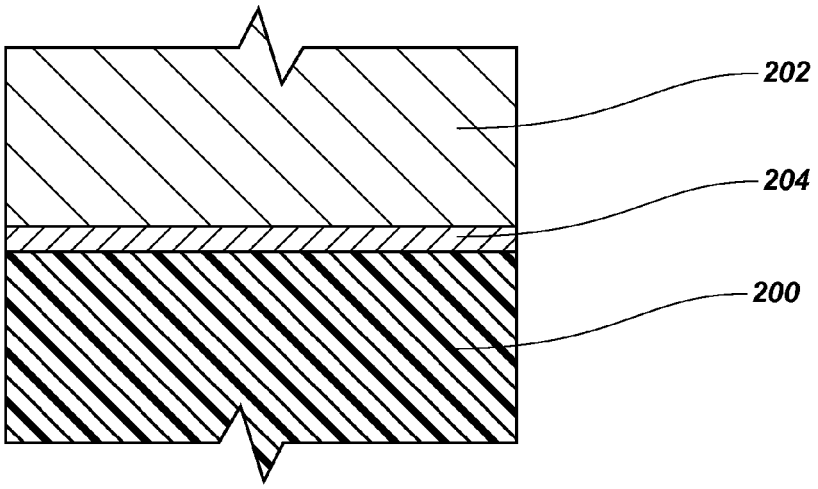
FIG. 4 illustrates a cross-sectional view of portions of downhole tool components that are coupled together in accordance with another embodiment of the present disclosure.

As shown in FIG. 3, the components of the bearing assembly 128 of the drill bit 100 are coupled to adjacent components or portions of the drill bit 100. The components of the bearing assembly 128 of the drill bit 100 may be coupled to the adjacent components or portions of the drill bit 100 by a joining process (e.g., a molten metal process such as, for example, brazing, soldering, etc.) utilizing ultrasonic energy (e.g., a high-frequency vibration of 20 kHz or more). For example, as shown in FIG. 4, a first downhole component 200 (e.g., a bearing member) formed from a diamond-enhanced material may be coupled to a second component 202 (e.g., a component or portion of the drill bit 100 (FIG. 1)) by ultrasonic molten metal techniques. For example, ultrasonic molten metal techniques such as those described in the U.S. Pat. No. 6,659,329 to Hall, issued Dec. 9, 2009, the disclosure of which is hereby incorporated herein in its entirety by this reference, may be used to couple the first downhole component 200 to the second component 202. Such ultrasonic molten metal techniques utilize vibrational energy causing intense agitation, which, in some embodiments, may cause cavitation on the surfaces of the downhole components 200, 202 to which the molten metal is to be applied. The cavitation breaks up and disperses the surface impurities (e.g., tightly adhering or embedded particles of contaminants such as, for example, dust, dirt, oil, pigments, and the like) on the downhole components 200, 202 enabling the molten metal to wet and bond to the surfaces of the downhole components 200, 202. It is noted that the molten metal techniques or processes as described herein are not limiting with regards to the melting point of the joining or filler material or the composition of the joining or filler material used in such processes. Rather, molten metal techniques or processes as described herein encompass any suitable brazing techniques or processes, soldering techniques or processes, or any other suitable techniques or processes that utilize any suitable joining or filler material (e.g., metal, metal alloys, etc.).

As shown in FIG. 4, the first downhole component 200 formed from a diamond-enhanced material may be coupled to the component 202 by joining material 204. In some embodiments, the joining material 204 used in the molten metal process may comprise a metal material in the form of a metal or metal alloy (e.g., tin, lead, indium, aluminum, magnesium, calcium, titanium, hafnium, zirconium, zinc, and alloys and combinations thereof). As used herein, the term "a metal material" encompasses both singular and plural metal materials.

The joining material 204 may be applied to one or more of the first downhole component 200 and the second downhole component 202 while ultrasonic energy is also applied to one or more of the downhole components 200, 202, and the joining material 204. In some embodiments, the joining material 204 may be applied to the one or more of the downhole components 200, 202 by a heating source comprising a tool or device (e.g., a heated iron such as, for example, a soldering iron) having an ultrasonic transducer in direct or indirect contact with the heating source, the downhole components 200, 202, and the joining material 204. For example, the joining material 204 may be applied between the downhole components 200, 202 by the heating source while ultrasonic energy is applied to or by the heating source. In additional embodiments, the joining material 204 may be applied to one of the downhole components (e.g., downhole component 200) and the downhole component 200 having the joining material 204 applied thereto may be subsequently coupled (e.g., with or without the use of ultrasonic energy) to the other downhole component (e.g., downhole component 202). In additional embodiments, the joining material 204 may be applied to both of the downhole components 200, 202 and the downhole components 200, 202 may be subsequently joined together by coupling the respective joining material 204 disposed on each of the downhole components 200, 202.

In some embodiments, one or more of the downhole components 200, 202 may be at least partially immersed in an ultrasonic molten metal pot having a pool of molten, liquid metal therein. Ultrasonic energy may be applied (e.g., by an ultrasonic transducer) to one or more of the molten metal pot, the downhole components 200, 202, and the liquid joining material. In some embodiments, both the downhole components 200, 202 may be immersed in the ultrasonic molten metal pot to form the joining material between the components 200, 202. In additional embodiments, the first downhole component 200 formed from a diamond-enhanced material may be placed in the ultrasonic molten metal pot to form a layer of metal or metal alloy (e.g., the joining material 204) around at least a portion of the first downhole component 200. The first downhole component 200 having the joining material 204 formed thereon may be subsequently coupled to the second downhole component 202 (e.g., with or without the use of ultrasonic energy). For example, the second downhole component 202 formed from, for example, a metal or metal alloy and the first downhole component 200 formed from a diamond-enhanced material may be joined to the second downhole component 202 with the joining material 204 previously formed on the first downhole component 200 during immersion in the molten metal pot. In additional embodiments, where the second downhole component 202 is formed from, for example, a composite material (a carbide, a diamond-enhanced material, or any other suitable wear-resistant materials), both downhole components 202 may have a joining material 204 formed thereon and may be subsequently coupled together through an additional joining process (e.g., molten metal process).

Figure 5:
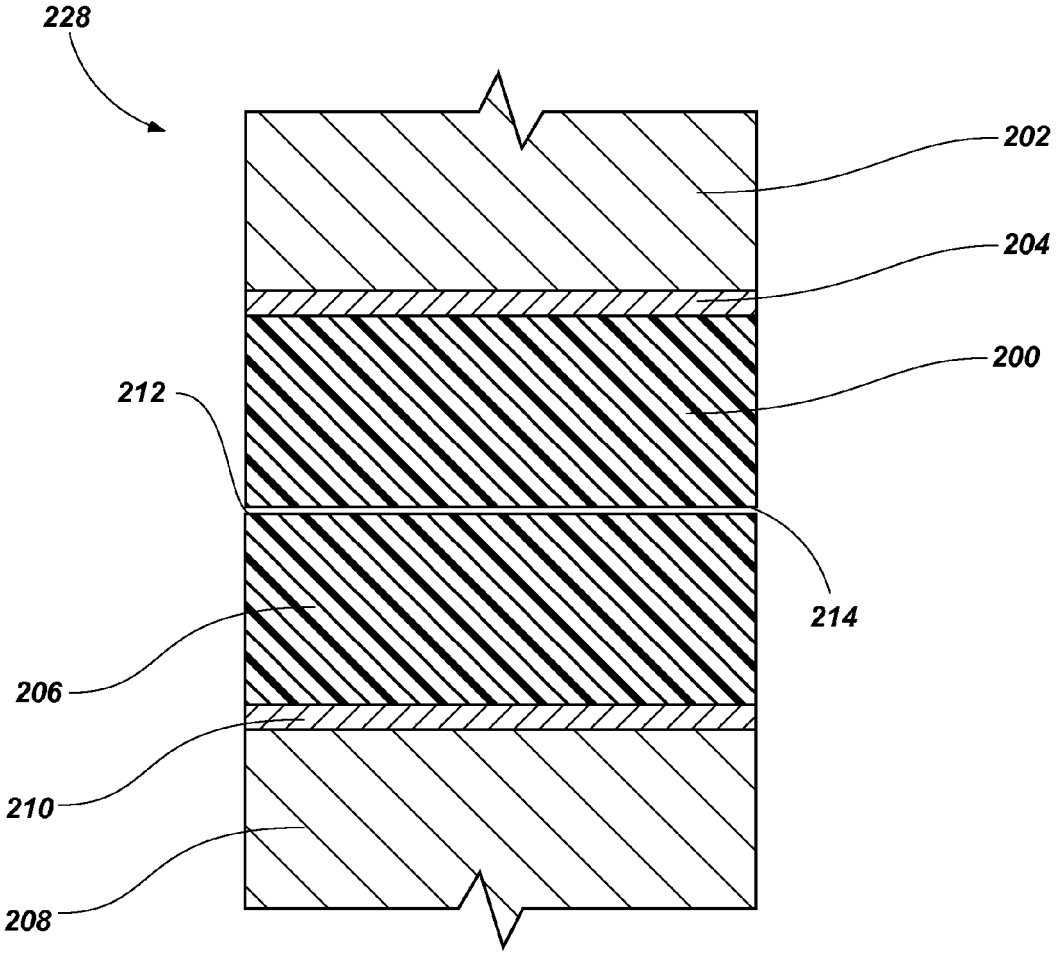
FIG. 5 illustrates a cross-sectional view of portions of downhole tool components comprising a bearing assembly that are coupled together in accordance with yet another embodiment of the present disclosure.

FIG. 5 illustrates components of a bearing assembly of a downhole tool that are joined using the ultrasonic molten metal techniques discussed above. As shown in FIG. 5, the bearing assembly 228 includes the downhole components 200, 202 joined together with joining material 204. Downhole components 206, 208 may be joined together with joining material 210 in a manner similar to those discussed above. The downhole components 200, 206 may each comprise a diamond-enhanced material joined using the ultrasonic molten metal technique to an adjacent portion or components of a downhole tool (e.g., downhole components 202, 208). The downhole components 200, 206 (e.g., substantially curvilinear components such as, for example, substantially cylindrical components, or substantially planar components) may be respectively joined to downhole components 202, 208 to enable the downhole components 200, 206 to move (e.g., by rotation or translation) with respect to each other in contact therewith. For example, each downhole component 200, 206 may have a load bearing surface 212, 214. Each of the load bearing surfaces 212, 214 formed from a wear resistant material (i.e., the diamond-enhanced material) may be move slidably relative to one another (e.g., by rotational or linear motion) primary cone bearing member 122, thereby enabling one or more portions of a downhole tool to move with respect to one another.

In some embodiments, during the ultrasonic molten metal techniques, a portion of the bearing assembly 228 may be masked to inhibit the joining material 204, 210 from being applied to the portions of the bearing assembly 228. For example, the bearing surfaces 212, 214 of the bearing assembly 228 may be masked to inhibit molten metal from joining thereto by a mask (e.g., a mask such as, for example, a polymer mask, having a melting point higher than the melting point of the joining material 204, 210). In other words, one or more surfaces of the bearing assembly 228 that are configured to rotate relative to another portion of the bearing assembly 228 and that are formed from diamond-enhanced material are masked to inhibit joining material (e.g., the molten metal) from adhering to those surfaces. For example, when installed in a downhole tool, a first bearing surface 212 of diamond-enhanced material may directly contact another portion of the downhole tool (e.g., a second bearing surface 214 of diamond-enhanced material) without any joining material therebetween. In additional embodiments, the bearing surfaces of the bearing assembly 228 may have any joining material removed therefrom before being installed in the downhole tool.

Referring again to FIG. 3, the components of the bearing assembly 128 of the drill bit 100 are coupled to adjacent components of the roller cone 106 as discussed above. For example, as shown in FIG. 3, each of the primary cone bearing member 122 and the secondary cone bearing member 123 may be coupled to the cone 106 using ultrasonic molten metal techniques. In a similar manner, each of the primary journal bearing member 124 and the secondary journal bearing member 125 may be coupled to the bearing pin 116 using ultrasonic molten metal techniques. As also discussed above, during the ultrasonic molten metal techniques, a portion of the bearing assembly 128 may be masked to inhibit the molten metal from being applied to the portions of the bearing assembly 128. For example, one or more bearing surfaces of the bearing assembly 128 (surfaces of the cone bearing members 122, 123 and journal bearing members 124, 125 forming interfaces 126, 129) may be masked to inhibit the molten metal from joining thereto. In additional embodiments, the bearing surfaces of the bearing assembly 128 may have any joining material removed therefrom before being installed in the drill bit 100.

Figure 6:
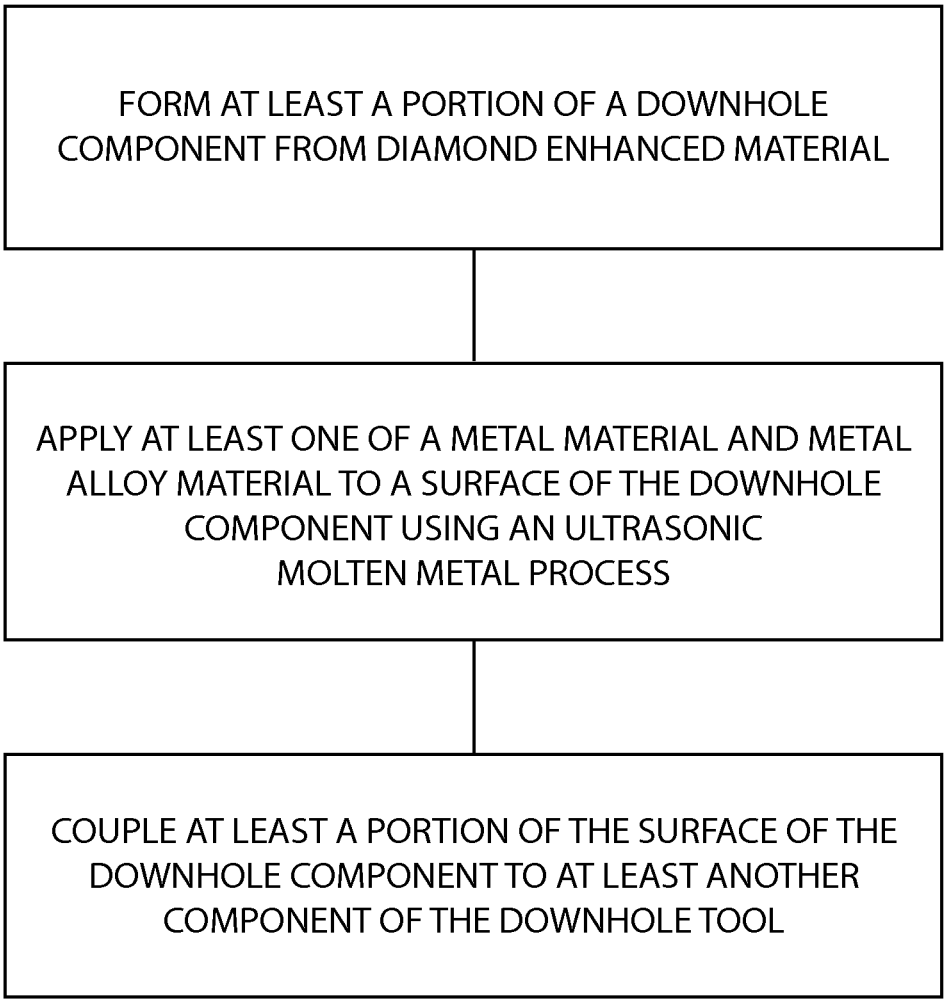
FIG. 6 is a flow chart illustrating a method of coupling a component to a downhole tool in accordance with an embodiment of the present disclosure.

FIG. 6 is a flow chart illustrating a method of coupling a component to a downhole tool in accordance with an embodiment of the present disclosure. As shown in FIG. 6, in some embodiments, methods of coupling a component to a downhole tool may include foaming at least a portion of the downhole component (e.g., bearing members 122, 123, 124, 125 (FIG. 3), downhole components 200, 206 (FIG. 5)) from a diamond-enhanced material (e.g., a silicon-bonded polycrystalline diamond). A metal material, a metal alloy material, or combinations thereof (e.g., joining material 204, 210 (FIG. 5)) may be applied to a surface of the downhole component using an ultrasonic molten metal process. At least a portion of the surface of the downhole component may be coupled to at least another component of the downhole tool (e.g., the bearing pin 116 (FIG. 3), the roller cone 106 (FIG. 3), downhole components 202, 208 (FIG. 5)).

Figure 7:
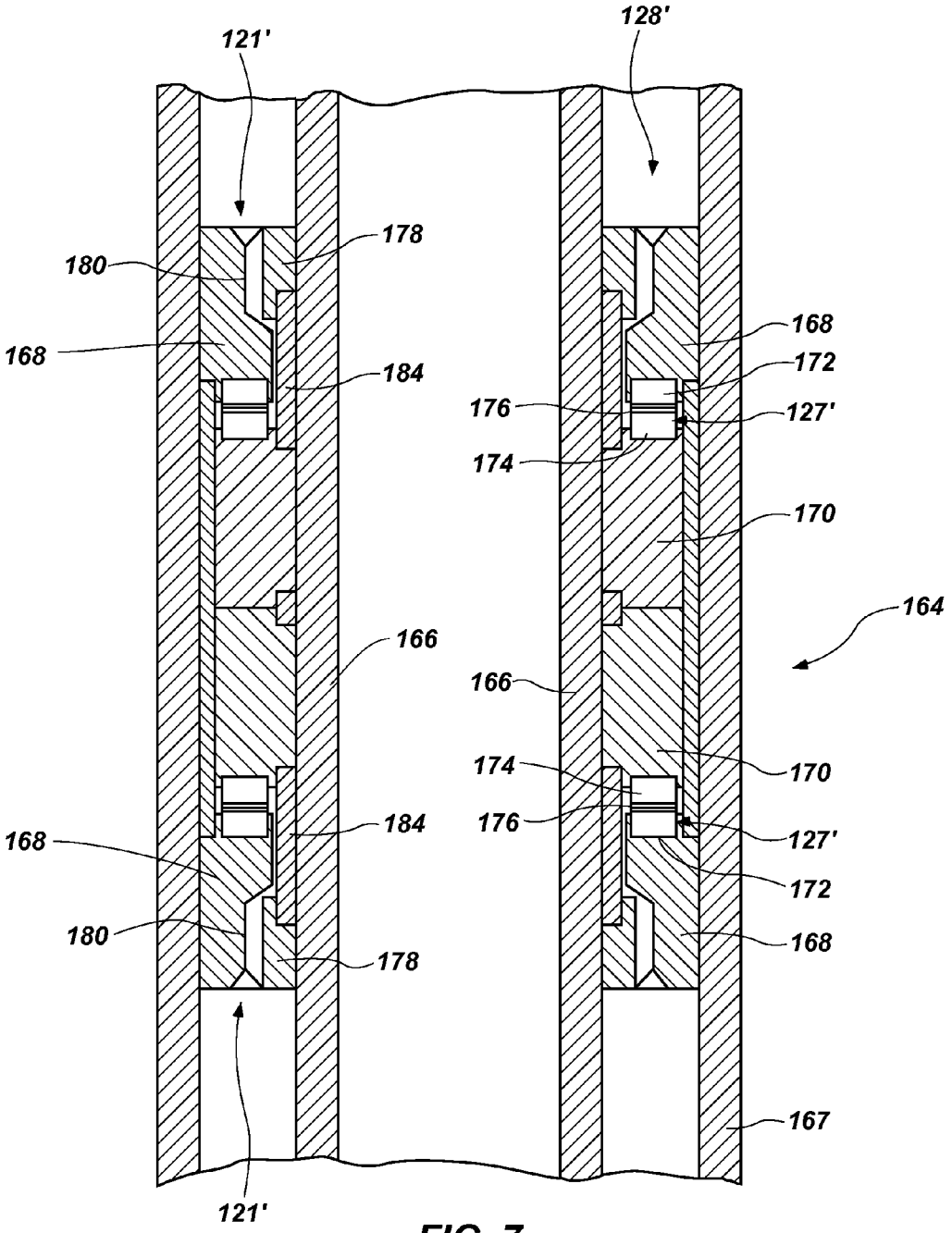
FIG. 7 illustrates a cross-sectional view of a downhole tool such as a downhole motor including components coupled thereto in accordance with an additional embodiment of the present disclosure.

Although the foregoing bearing assembly 128 was described as being employed in an earth-boring rotary drill bit, persons of ordinary skill in the art will understand that bearings in accordance with embodiments of the disclosure may be employed in other downhole tools. For example, a bearing assembly 128' in accordance with the present disclosure may be employed in a downhole motor 164, as shown in FIG. 7. The downhole motor 164 may comprise, for example, a Moineau-type "mud" motor or a turbine motor. The downhole motor 164 includes a bearing assembly 128' in accordance with an embodiment of the present disclosure. Components above and below the actual bearing assembly 128' are not illustrated. The downhole motor 164 includes a central tubular downhole motor driveshaft 166 located rotatably within a tubular bearing housing 167, with the downhole motor bearing assembly 128' located and providing for relative rotation between the driveshaft 166 and the housing 167. Those skilled in the art will recognize that the driveshaft 166 is rotated by the action of the downhole motor 164 and supplies rotary drive to a drill bit, such as the drill bit 100 illustrated in FIGS. 1 and 2. The housing 167 remains rotationally stationary during motor operation.

The bearing assembly includes at least one axial bearing 127'. In the embodiment shown in FIG. 7, the bearing assembly 128' includes two annular axial bearings 127'. The axial bearings 127' include a pair of outer bearing rings 168 and a pair of inner bearing rings 170. Each outer bearing ring 168 includes a first axial bearing member 172 and each inner bearing ring 170 includes a second axial bearing member 174. The first axial bearing member 172 abuts against the second axial bearing member 174 at an interface 176. The first and second axial bearing members 172, 174 are configured to rotate slidably against one another and to bear axial loads acting on the downhole motor 164. Like the axial cone and journal bearing members 123, 125 described hereinabove, the first and second axial bearing members 172, 174 may be coupled to adjacent portions of the downhole motor such as, for example, another component of the bearing assembly 128' by the ultrasonic molten metal techniques described above. For example, each axial bearing member 172, 174 may be formed from a diamond-enhanced material and may be coupled to one of the inner and outer bearing rings 168, 170 by a joining material 204, 210 like that shown in FIG. 5.

The bearing assembly 128' also includes at least one radial bearing 121'. In the embodiment shown in FIG. 7, the bearing assembly 128' includes two radial bearings 121'. Each radial bearing 121' includes a rotating radial bearing member 178 that runs, at a bearing interface 180, against a portion of the outer bearing ring 168. The radial bearing member 178 is concentrically nested with the outer bearing ring 168, and the spacer ring 184 is concentrically nested with the radial bearing member 178. Like the journal and cone bearing members 122 and 124 described hereinabove, the radial bearing members 178 may be coupled to adjacent portions of the downhole motor such as, for example, another component of the bearing assembly 121' by the ultrasonic molten metal techniques described above. For example, each radial bearing member 178 may be formed from a diamond-enhanced material and may be coupled to one or more of a spacer ring 184 and the central tubular downhole motor driveshaft 166 by a joining material 204, 210 like that shown in FIG. 5.

Embodiments of the present disclosure may be particularly useful in the coupling of downhole components including bearing assemblies formed, at least partially, from diamond-enhanced materials. The downhole components may be coupled with ultrasonic molten metal processes that utilize vibrational energy, which may cause cavitation on the surfaces of the downhole components to which the joining material is to be applied. The cavitation breaks up and disperses the surface impurities on the downhole components enabling the joining material to wet and bond to the surfaces of the downhole components. Such coupling processes may aid in the coupling of diamond-enhanced material that may be relatively difficult to bond to other portions or components of a downhole tool such as, for example, a portion or component formed from a metal or metal alloy.

While the present disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure encompasses all modifications, variations, combinations, and alternatives falling within the scope of the disclosure as encompassed by the following appended claims and their legal equivalents.

What is claimed is:

1. A method of coupling a bearing assembly to a downhole tool, comprising:

forming an entirety of a downhole component from a diamond-enhanced material comprising a continuous phase matrix material and discrete particles of diamond material embedded in and dispersed throughout an entire thickness of the continuous phase matrix material;

applying a metal material to a bare, diamond-enhanced surface of the downhole component using an ultrasonic molten metal brazing process, the bare, diamond-enhanced surface of the downhole component discrete from the metal material prior to the ultrasonic molten metal brazing process; and coupling the downhole component to at least another downhole component using the metal material.

2. The method of claim 1, wherein applying a metal material to a bare, diamond-enhanced surface of the downhole component using an ultrasonic molten metal process brazing comprises:

masking a portion of the bare, diamond-enhanced surface of the downhole component; and applying the metal material to remaining portion of the bare, diamond-enhanced surface of the downhole component.

3. The method of claim 1, wherein applying a metal material to the bare, diamond-enhanced surface of the downhole component using an ultrasonic molten metal brazing process comprises applying ultrasonic energy to at least one of the downhole component and the downhole tool.

4. The method of claim 1, wherein forming an entirety of a downhole component from a diamond-enhanced material comprises forming the entirety of the downhole component from silicon-bonded polycrystalline diamond.

5. The method of claim 1, wherein coupling the downhole component to at least another downhole component comprises coupling the downhole component to the at least another downhole component formed from a metal or a metal alloy.

6. The method of claim 1, wherein applying a metal material to the bare, diamond-enhanced surface of the downhole component using an ultrasonic molten metal brazing process comprises at least partially immersing the downhole component in an ultrasonic molten metal pot having a pool of the metal material therein.

7. The method of claim 1, wherein applying a metal material to the bare, diamond-enhanced surface of the downhole component using an ultrasonic molten metal brazing process comprises applying the metal material to the bare, diamond-enhanced surface of the downhole component with a heating source while simultaneously applying ultrasonic energy to at least one of the heating source, the downhole component, and the downhole tool.

8. The method of claim 1, wherein forming an entirety of a downhole component from a diamond-enhanced material comprises forming the at least a portion of the downhole component from a material comprising one of:

diamond grains in a matrix of tungsten carbide;

a high temperature, high pressure sintered silicon-bonded polycrystalline material;

a high temperature, low pressure sintered diamond;

a high temperature, low pressure sintered silicon-bonded polycrystalline material;

a silicon-bonded carbide material; and an aluminum nitride intermetallic bonded diamond and carbide composite.

9. The method of claim 1, wherein:

forming an entirety of a downhole component from a diamond-enhanced material comprises forming at least two bearing components configured to contact and move relative to one another on the downhole tool from a diamond-enhanced material;

applying a metal material to a bare, diamond-enhanced surface of the downhole component using an ultrasonic molten metal brazing process comprises applying the metal material to a bare, diamond-enhanced surface of each of the at least two opposing bearing components using the ultrasonic molten metal brazing process; and coupling the downhole component to at least another component using the metal material comprises coupling the at least a portion of the diamond-enhanced material of each of the at least two opposing bearing components to different components of the downhole tool using the metal material, the different components configured and positioned, when the downhole tool is operable, to place the two bearing components in movable contact.

10. The method of claim 9, wherein forming at least a portion of a downhole component from a diamond-enhanced material further comprises forming the at least two opposing bearing components to each exhibit a bearing surface having a substantially cylindrical geometry.

11. The method of claim 9, wherein forming an entirety of a downhole component from a diamond-enhanced material further comprises forming the at least two opposing bearing components to each exhibit a bearing surface having a substantially planar geometry.

12. A method of coupling a diamond-enhanced material to a downhole tool, comprising:

forming a diamond-enhanced material comprising a continuous phase matrix material and discrete particles of diamond material embedded in and dispersed throughout an entire thickness of the continuous phase matrix material;

applying a metal material to a bare, diamond-enhanced surface of the diamond-enhanced material discrete from the metal material using only an ultrasonic molten metal brazing process; and bonding the diamond-enhanced material to the downhole tool with the metal material in a solid state.

13. The method of claim 12, wherein forming a diamond-enhanced material comprises forming a silicon-bonded diamond material.

14. A downhole tool including a bearing assembly comprising at least one bearing component being movable relative to a portion of the downhole tool, the at least one bearing component consisting of a continuous phase matrix material and discrete particles of diamond material embedded in and dispersed throughout an entire thickness of the continuous phase matrix material, the at least one bearing component coupled to another portion of the downhole tool by a metal material formed on a bare, diamond-enhanced surface of the bearing component through an ultrasonic molten metal brazing process.

15. The downhole tool of claim 14, wherein the at least one bearing component consists of one of:

diamond grains in a matrix of tungsten carbide;

a high temperature, high pressure sintered silicon-bonded polycrystalline material;

a high temperature, low pressure sintered diamond;

a high temperature, low pressure sintered silicon-bonded polycrystalline material;

a silicon-bonded carbide material; and an aluminum nitride intermetallic bonded diamond and carbide composite.

16. The downhole tool of claim 14, wherein the at least one bearing component consists of a silicon-bonded diamond material and wherein the at least one bearing component is coupled to at least one adjacent component of the downhole tool comprising at least one of a metal and a metal alloy.

17. The downhole tool of claim 14, wherein the at least one bearing component comprises at least two opposing bearing components configured to rotate relative to one another on the downhole tool, the at least two opposing, mutually relatively rotatable bearing components comprising diamond-enhanced materials coupled to different portions of the downhole tool by ultrasonic molten metal brazing processes.

18. The downhole tool of claim 14, wherein the at least one bearing component comprises at least two opposing bearing components configured to translate relative to one another on the downhole tool, the at least two opposing, mutually relatively translatable components comprising diamond-enhanced materials coupled to different portions of the downhole tool by ultrasonic molten metal brazing processes.

19. The downhole tool of claim 14, wherein the at least one bearing component comprises at least one of a substantially cylindrical geometry and a substantially planar geometry.

* * * * *

UNITED STATES PATENT AND TRADEMARK OFFICE

CERTIFICATE OF CORRECTION

PATENT NO. : 9,273,518 B2
APPLICATION NO. : 13/283049
DATED : March 1, 2016
INVENTOR(S) : Redd H. Smith, James Andy Oxford and Alan J. Massey It is certified that error appears in the above-identified patent and that said Letters Patent is hereby corrected as shown below:

In the specification:

| | | |
|---|---|---|
| COLUMN 3, | LINE 3, | change "is a flow chart" to --is a flowchart-- |
| COLUMN 3, | LINE 41, | change "rotary drill bit," to --rotary drill bits,-- |
| COLUMN 4, | LINES 21-22, | change "into a bore-hole" to --into a borehole-- |
| COLUMN 5, | LINE 27, | change "in the ball race." to --in the ball race 130.-- |
| COLUMN 8, | LINE 12, | change "components **202**" to --components **200, 202**-- |
| COLUMN 8, | LINE 36, | change "may be move" to --may be moved-- |
| COLUMN 8, | LINE 38, | change "motion) primary cone bearing member **122**," to --motion),-- |
| COLUMN 9, | LINE 17, | change "flow chart" to --flowchart-- |
| COLUMN 9, | LINE 21, | change "include foaming" to --include forming-- |
| COLUMN 9, | LINE 55, | change "assembly includes" to --assembly 128′ includes-- |
| COLUMN 10, | LINE 2, | change "downhole motor" to --downhole motor **164**,-- |
| COLUMN 10, | LINE 20, | change "motor such as," to --motor **164**, such as,-- |
| COLUMN 10, | LINE 21, | change "assembly **121′**" to --assembly **128′**-- |

In the claims:

| | | | |
|---|---|---|---|
| CLAIM 2, | COLUMN 11, | LINE 7, | change "to remaining" to --to a remaining-- |
| CLAIM 9, | COLUMN 11, | LINES 53-54, | change "two bearing" to --two opposing bearing-- |

Signed and Sealed this
Nineteenth Day of July, 2016

Michelle K. Lee

Michelle K. Lee
*Director of the United States Patent and Trademark Office*